US005477623A

United States Patent [19]

Tomizawa et al.

[11] Patent Number: 5,477,623

[45] Date of Patent: Dec. 26, 1995

[54] DRYING APPARATUS

[75] Inventors: Takeshi Tomizawa, Ikoma; Tatsuo Fujita; Kunihiro Ukai, both of Osaka; Jiro Suzuki, Nara, all of Japan

[73] Assignee: Matsushita Electric Industrial Co., Ltd., Osaka, Japan

[21] Appl. No.: 155,282

[22] Filed: Nov. 22, 1993

[30] Foreign Application Priority Data

Nov. 25, 1992 [JP] Japan ..... 4-315031

[51] Int. Cl.[6] ..... F26B 17/24

[52] U.S. Cl. ..... 34/58; 34/321; 34/386; 34/181

[58] Field of Search ..... 34/210, 218, 179, 34/181, 386, 391, 58, 312, 318, 328, 326–327, 321, 73, 63, 66

[56] References Cited

U.S. PATENT DOCUMENTS

| | | | |
|---|---|---|---|
| 2,361,894 | 10/1944 | Williams | 34/58 |
| 4,882,851 | 11/1989 | Wennerstrum et al. | 34/60 |
| 5,150,531 | 9/1992 | Meglio | 34/179 |

FOREIGN PATENT DOCUMENTS

| | | |
|---|---|---|
| 442620 | 7/1971 | Australia . |
| 0210966 | 2/1987 | European Pat. Off. . |
| 0343817 | 11/1989 | European Pat. Off. . |
| 523816 | 8/1921 | France . |
| 1018720 | 1/1953 | France . |
| 2827590 | 1/1980 | Germany . |
| 1-139182 | 5/1989 | Japan . |
| 303370 | 11/1954 | Switzerland . |

*Primary Examiner*—Denise L. Gromada
*Attorney, Agent, or Firm*—Wenderoth, Lind & Ponack

[57] ABSTRACT

A drying apparatus for drying a moist material includes a container having an opening for receiving the material therein. A top cover is provided for closing the opening of the container. A heater and fan are provided on the bottom of the top cover so as to confront to the opening of the container when the top cover is closed. The heater and fan produce and blow a heated air stream toward the material to vaporize the moisture therein. A rotary drive unit is provided under the container to rotates the container for mixing the material. By the mixing operation, the material is stirred such that the inside portion the of material is moved up and is exposed to the heated air stream. The vapor released from the heated material is vent ed to the outside of the apparatus through a ventilation unit.

33 Claims, 7 Drawing Sheets

DRYING APPARATUS

BACKGROUND OF THE INVENTION

1. Field of the Invention

The present invention relates to a drying apparatus suitable to residential use that can be used compactly, conveniently, and hygienically for drying wet materials requiring dryprocessing such as foodstuffs and raw waste generated in the kitchen, including cooking wastes and leftover food, containing relatively large amounts of moisture.

2. Description of the Prior Art

Drying processes that reduce weight and prevent decomposition are widely used to enable long-term storage of foodstuffs. Other than open-air drying using natural sunlight, foodstuff drying processes using some apparatus include heater drying, forced hot-air drying, microwave drying, freeze-drying, and spray drying methods.

These latter methods play an important role in the foodstuff drying industry because of the ability to dry foodstuffs rapidly when compared with open-air sunlight drying. However, those methods are suitable for the large scaled apparatuses but not for compact apparatuses. One of most compact apparatus utilizing those methods which is really in use is a clothes drier for drying clothes by means of electric power. In this clothes drier, clothes with moisture are held in a drum rotating with respect to a horizontal axis and are blown by a hot air to dry. Since the clothes easily suffer from heat, the hot air should be controlled at a temperature of 70° C. or less. However, water will not boil at thus controlled temperature. Therefore, it is necessary to make the hot air dried. To prepare the dried hot air, the air taken in the apparatus from the outside is heated by the heater to reduce the relative humidity thereof. This relatively dried hot air is blown to the wet clothes to absorb the water vapor from the closes, and hot air containing the water vapor is exhausted the outside. Thus, the clothes are dried.

However, in this type of drying apparatuses, there are following problems. First is that the large sized heat recovering device is necessary to recover the great amount of heat lost together with the exhausted hot air. It is because that a heat recovering rate should be small due the smaller temperature difference between the exhausted air and the outside air. Second is that easily lumping stuffs such as raw wastes from the kitchen can not be dried by thus heated relatively dried air having a lower temperature. Third is that the bad odor from the decomposed stuffs by the drying process is released outside together with the exhausted air.

As with foodstuffs and raw wastes from the kitchen, weight reduction and decomposition prevention have also become desirable for raw wastes generated in the home.

Residential raw wastes are collected by local municipalities, but must be stored for some period in the home until collection because they are not collected every day. During this storage, the raw wastes decompose and begin to smell, the garbage storage site is soiled by garbage fluids, etc., and the garbage itself becomes dirty.

From the perspective of environmental conservation, reducing the amount of garbage has become socially promoted.

Methods for drying raw wastes in the same way as foodstuffs to reduce the volume and prevent decomposition have therefore been proposed. Methods for fermenting raw wastes during the drying process for re-use as fertilizer have also been proposed.

However, devices for drying foodstuffs easily, and devices for successfully drying without decomposing the raw wastes or releasing foul odors are virtually unavailable for residential use, even though many drying apparatuses for industrial use are available.

On the other hand, there are many problems left for the application of drying methods used commercially to residential drying methods.

Evenly drying the process materials is extremely difficult using microwave drying methods with devices having little space inside because of the microwave intensity distribution.

In drying methods using a heater, problems include the extremely long drying time required when the drying temperature is set low to prevent overheating and fire.

Regarding the treatment of odors and waste water produced during drying of foodstuffs and raw wastes, there are no compact drying apparatuses designed for deodorization and waste water treatment, and resolving these concerns has been a major problem.

SUMMARY OF THE INVENTION

The object of the present invention is therefore to provide a drying apparatus which solves these problems.

The present invention has been developed with a view to substantially solving the above described disadvantages and has for its essential object to provide an improved drying apparatus.

A drying apparatus for drying a material including moisture, said apparatus comprises container means for receiving said material; hot air stream generation means provided inside said container means for producing a heated air stream and blowing said heated air stream toward said material to vaporize the moisture in said material into a vapor; mixing means for mixing said material, said mixed material being exposed to said heated air stream; and ventilation means for venting said vapor to the outside of said container means.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

First Embodiment

Figure 1:
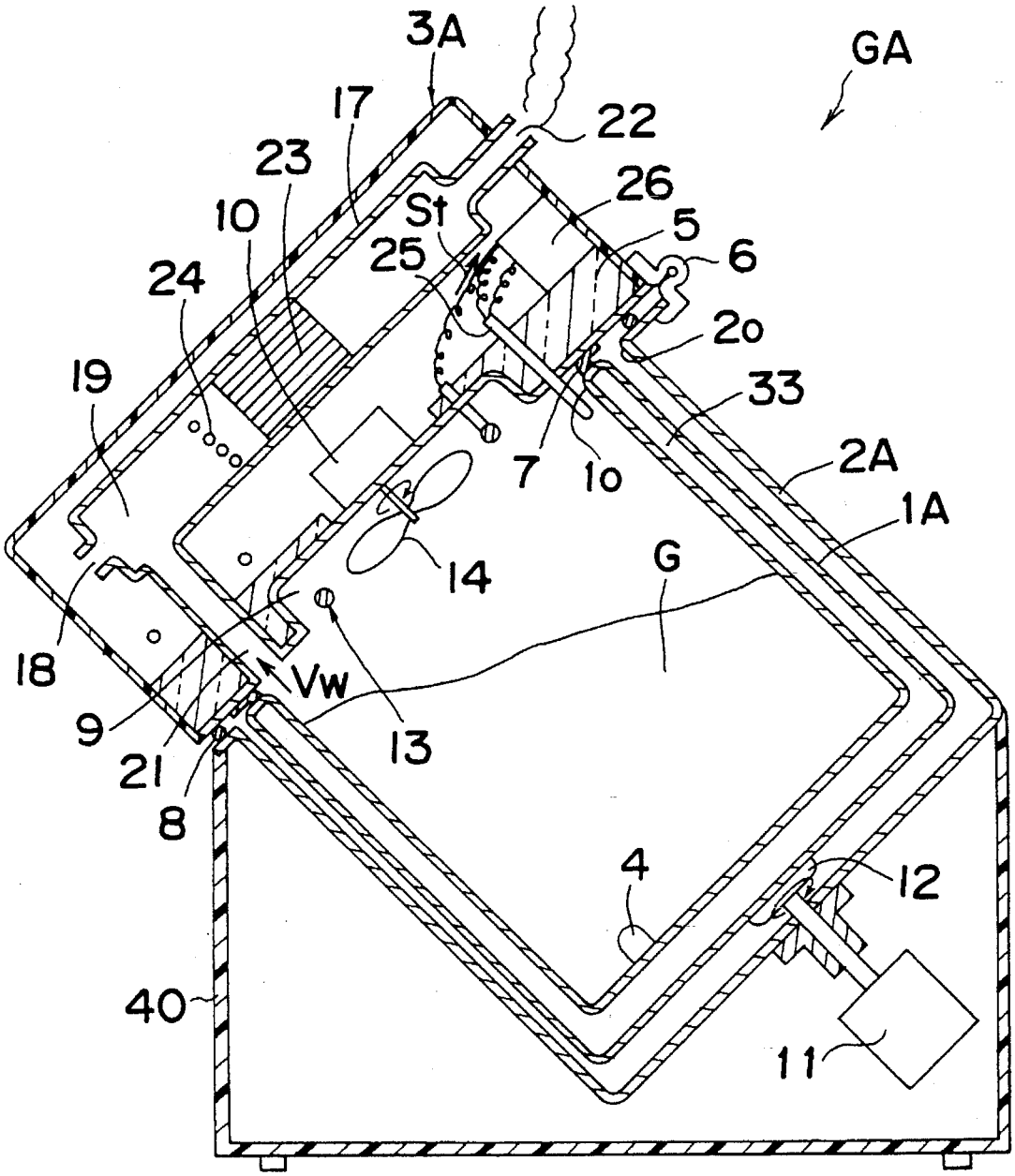
FIG. 1 is a cross-sectional view showing a drying apparatus according to a first embodiment of the present invention.

Referring to FIG. 1, a drying apparatus according to a first embodiment of the present invention is shown. The drying apparatus GA includes a container 1A for holding a wet materials G requiring a dryprocessing therein. The wet materials G are stuffs containing relative large amounts of moisture such as foodstuffs and raw waste generated in the kitchen, including cooking wastes and leftover food.

The container 1A is formed in a generally elongated cylindrical box-like configuration having a circumferential side wall portion and a bottom wall portion. The opposite side of the bottom wall portion is opened at 1*o*. The container 1A is double-wall construction with a heat insulation space 33 formed between inner wall and outer wall, as best shown in FIG. 1. The container 1A is further provided with a mixing member 4 at the inner bottom wall near the circumference wall thereof.

A main housing 2A having an opening 2*o* at one side opposed to a bottom thereof is supported by a base 40 in a tilted posture such that the opening 2*o* opens in the diagonal upward direction. Around the end of opening 2*o*, a flange is provided. The main housing 2A is provided with a rotary drive unit 11 having a driving shaft on the underside of the bottom thereof. The driving shaft rotatably protrudes inside of the main housing 2A. A transfer plate 12 is provided at a free end of the driving shaft of the rotary drive unit 11.

The container 1A is housed inside the main housing 2 in a tilted posture such that the outer side of bottom wall portion thereof rests on the transfer plate having an inclination angle with respect to the vertical axis of the apparatus GA when the apparatus GA is properly installed. Thus supported container 1A can be rotated by the rotary drive unit 11, and can be easily removed from the main housing 2A by detaching the bottom thereof from the transfer plate 12.

The container 1A further includes a cover lid 3A are also formed in a flat cylindrical box-like configuration large enough to cover the opening 2*o* of the main housing 2A. The cover lid 3A is connected to the main housing 2A by a hinge 6 provided at the top position of the main housing 2A such that the cover lid 3A naturally closes by the gravitation. The hinge 6 can be provided at any position suitable for opening and closing the openings 1*o* and 2*o* by swinging the cover lid 3A around the hinge 6.

On the bottom surface of the cover lid 3A, provided are an O-ring 8 big enough to contact the flange part of the opening 2*o* of the main housing. 2A and a seal lip 7 having a diameter large enough to receive the free end of the opening 1*o* of the container 1A. When the cover lid 3A is closed, the O-ring 8 is pressed against the flange part of the opening 2*o* to seal the main housing 2A from the outside of the drying apparatus GA, and the seal lip 7 is pressed against to the free end of the container 1A. A heating unit 13 comprised of a sheathed heater, and an air blower 14 comprised of a fan are provided at a recessed inner bottom portion of the cover lid 3A. When the cover lid 3A is closed, the heating unit 13 and air blower 14 oppose to the opening 1*o* of the container 1A, so that the air blower 14 can blow air heated by the heating unit 13 into the container 1A. Thus, a hot air stream blowing toward the bottom of container 1A can be produced. It is to be noted that the air blower 14 can be controlled by the controller 26 or other suitable control means.

Inside of the cover lid 3A, a heat insulation material 5 is provided on the bottom wall thereof. A vapor vent channel 17 is also provided. The vapor vent channel 17 has an inlet port 21 opened at the bottom wall of the cover lid 3A for taking in the vapors released from the wet material G in container 1A, and has an outlet port 22 opened at side wall of the cover lid 3A. The vapor vent channel 17 has an air mixing unit 19 provided at some midpoint between the inlet and outlet ports 21 and 22 for mixing the outside air introduced from an intake opening 18 opened to the inside the cover lid 3A with the vapor taken in through the inlet port 21.

An oxidation catalyst 23 is provided between the outlet port 22 and the air mixing unit 19, on the downstream side of the air mixing unit 19, and is heated by a heater 24 to promote the catalytical reaction with the vented vapor mixed with the outside air. This heater 24 can also be used in common with the heating unit 13.

A temperature detector 25 for detecting the temperature inside the container 1A near the opening 1*o* is provided in one part of the cover lid 3A and producing a temperature St signal based on the detected temperature. A controller 26 is also provided inside the cover lid 3A for controlling the heating unit 13 based on the temperature signal St indicative of the temperature inside the container 1A.

Herebelow, the operation of the drying apparatus GA is described. At first step, the cover lid 3A is opened and the wet material G including raw wastes and other wet materials is loaded in the container 1A. The electric current is supplied to the sheathed heater of heating unit 13, so that the heating unit 13 releases the heat into the container 1A to heat the wet material G loaded in the container 1A. By also operating the fan, which is the air blower 14, at the same time, a hot air stream is produced and is forcibly blowing toward the wet material G on the bottom of container 1A. As a result, the moisture included in the material G is heated and a water vapor Vw is released therefrom.

By rotating the container 1A by the rotary drive unit 11 at this time, the wet material G inside the container 1A is mixed by repeatedly being lifted to the limit position exceeding the angle of repose by the inside surface of the container 1A and the mixing member 4, and falling naturally. At the same time, the temperature of the container 1A is detected by the temperature detector 25 during this drying process, and the power supply to the heating unit 13 is adjusted by the controller 26 based on that temperature signal St to control the heating of the wet material G.

Part of the water vapor Vw released from the wet material G flows naturally to the outside of the container 1A passing through the vapor vent channel 17, but most is reheated by the heating unit 13 to superheated steam with a high heat value and blown into the wet material G again.

The water vapor Vw passing the vapor vent channel 17 to outflow naturally is mixed at the air mixing unit 19 with the outside air taken through the intake opening 18, so that the oxygen needed for catalytical reaction with the oxidation catalyst 23 is supplied. The vapor thus mixed with the oxygen is heated by the heater 24 to flow upward actively and towards the outlet port 22, contacting at this time the oxidation catalyst 23 which is also heated by the heater 24 for improved reaction performance. Thus, the water vapor Vw reacts well with the catalyst 23 and is sufficiently deodorized before venting to the outside from the outlet port 22.

As a result, there is no excess vapor left in the container 1A. Such excessive vapor may be causes for delaying of drying wet material G due to condensation of vapor Vw by temperature differences, and thermal decomposition. Since the water Vw vented outside is sufficiently deodorized, there is no interference with the hygiene of the environment.

Furthermore, in this embodiment, the heat insulation space 33 of the container 1A, filled with air, foamed plastics or vacuum, forms a heat insulating means for thermally insulating the container 1A together with the heat insulation material 5 of the cover lid 3A. Thus formed heat insulating means prevents the heat inside the container 1A from escaping to the outside without requiring any special placement for heat insulation. Drying the wet material G can be achieved with a simple construction and good heat efficiency, and costs can be kept low.

The air blower 14 mixes air with the heat produced by the heating unit 13 for supply to the container 1A during initial stage of heating wet material G. But after the wet material G reaches 100° C., the air blower 14 performs the mixing the water vapor Vw and forced air supply of superheated steam.

Uniform drying evaluation tests using raw waste as the wet material G were conducted with this embodiment. In heating methods using conventional heat transmission and radiation, only the surface of the wet material exposed to the heat is dried and an dried heat insulating layer is formed at the surface thereof. It was difficult to sufficiently and evenly heat all of the wet material through this heat insulating dried surface layer.

However, using the heater and fan combination and the mixing mechanism of the present embodiment, the heat insulating dried surface layer can be broken and the wet part inside the material is moved up and exposed to the hot air. Therefore, the sampled wet material was thoroughly heated by forced hot air, and by using the superheated steam with a high heat value for heating, uniform, good efficiency heating was possible.

In addition, because the heat insulation is excellent, it was possible to heat with good heat efficiency and quickly dry all of the raw waste.

In this case, the insulating space is vacuum, which provides another effect as below.

In a conventional apparatus comprising such a mixing mechanism as described above, the release of noise, and particularly low frequency vibrations, into the room by a mixing mechanism a problem. Because high frequency vibration noise can be blocked by providing sound insulation inside the walls, but propagation of low frequency vibration cannot be prevented with common sound insulation materials.

However, according to the present invention, with the double-wall construction of the container 1A having a vacuum heat insulation space 33, the vacuum heat insulation space 33 does not propagate sound waves even when the inside walls vibrate, and transmission of sound can be prevented regardless of the frequency.

Although high frequency sound propagated by metal and transmitted to the outside wall cannot be blocked even by the container 1A with a vacuum heat insulation space 33, quiet and noise-free operation can be achieved by the present invention because high frequency sound can be easily blocked using a sound insulation material.

By setting and rotating the container 1A at an angle, the sample inside the container is frequently mixed, and scorching and sticking of the wet material G to the inside walls of the container 1A late in the drying process can be held to the minimum. The angle of inclination at this time can be selected anywhere between 40° to 90° with respect to the vertical axis of the apparatus GA, and the mixing effect is greater as the inclination angle is greater.

In addition, by controlling rotation of the container 1A and reversing the direction, more uniform, rapid heating is possible, the crushing effect on the wet material G during processing can be increased, and the volume of the wet material G can be sufficiently reduced.

With the conventional methods, the wet material G becomes gummy due to moisture during initial heating. With the method according to the present invention, it is difficult for wet material G to scorch and stick to the walls of the container 1A, and the container 1A is not easily soiled because the superheated hot air reaches throughout the mixed material G which dries from all surfaces. In addition, by keeping the container 1A at a constant temperature such that the power supply to the heating unit 13 is controlled to heat the container 1A with an upper limit of 130° C, the wet material G is uniformly heated, scorching is suppressed, and the breakout of fire can be prevented.

Good drying can be accomplished even at 130° C., a temperature that can prevent dechlorination of chloride plastics which may be used in the drying apparatus GA or even included in the wet material G.

By means of this construction, the wet material G can be processed to nearly absolute dryness, and decomposition can be prevented. In addition, the release of foul odors from oxidation can be controlled by uniform drying and heating the water vapor Vw vented outside.

Therefore, compared with conventional transmission and radiation type heating methods, the drying time can be significantly reduced because the superheated water vapor Vw condenses and heats the low temperature part of the wet material G.

In addition, because most of the water vapor Vw is recirculated in a superheated state in the container 1A and used for drying, unlike conventional spray drying methods, heat efficiency is high, and environmental hygiene is not disrupted because the water vapor Vw vented outside is deodorized by contact with the oxidation catalyst 23, which also results in preventing damage to the apparatus GA caused by the superheated steam.

While insulating the container 1A as in this embodiment is desirable to prevent heat loss and to conserve energy, the specific method of insulation is not specified. However, because the insulation effect improves when a heat insulation structure is used, temperature variations in the wet material G occur with difficulty. This is because with an insulation space 33, and the temperature rise in the walls is faster.

When drying small quantities of wet material G in particular, condensation of vapor at the wall of container 1A is faster, and the uniformity of drying improves.

The air blower 14 is provided in the recessed bottom of cover lid 3A at the position near the heating unit 13 in this embodiment, but it may be placed at any position from which heat generated by the heating unit 13 and the superheated steam can be blown into the wet material G. Any type of fan can also be used for the air blower 14.

However, high heat efficiency can be achieved when an arc-shaped heater is provided as the heating unit 13 extending around an axial flow fan. In addition, the rotary drive unit 11 is provided at the bottom of the main housing 2A, but any type of rotary drive mechanism can be provided at any place for rotating the container 1A without being limited to direct motor drive.

Second Embodiment

Figure 2:
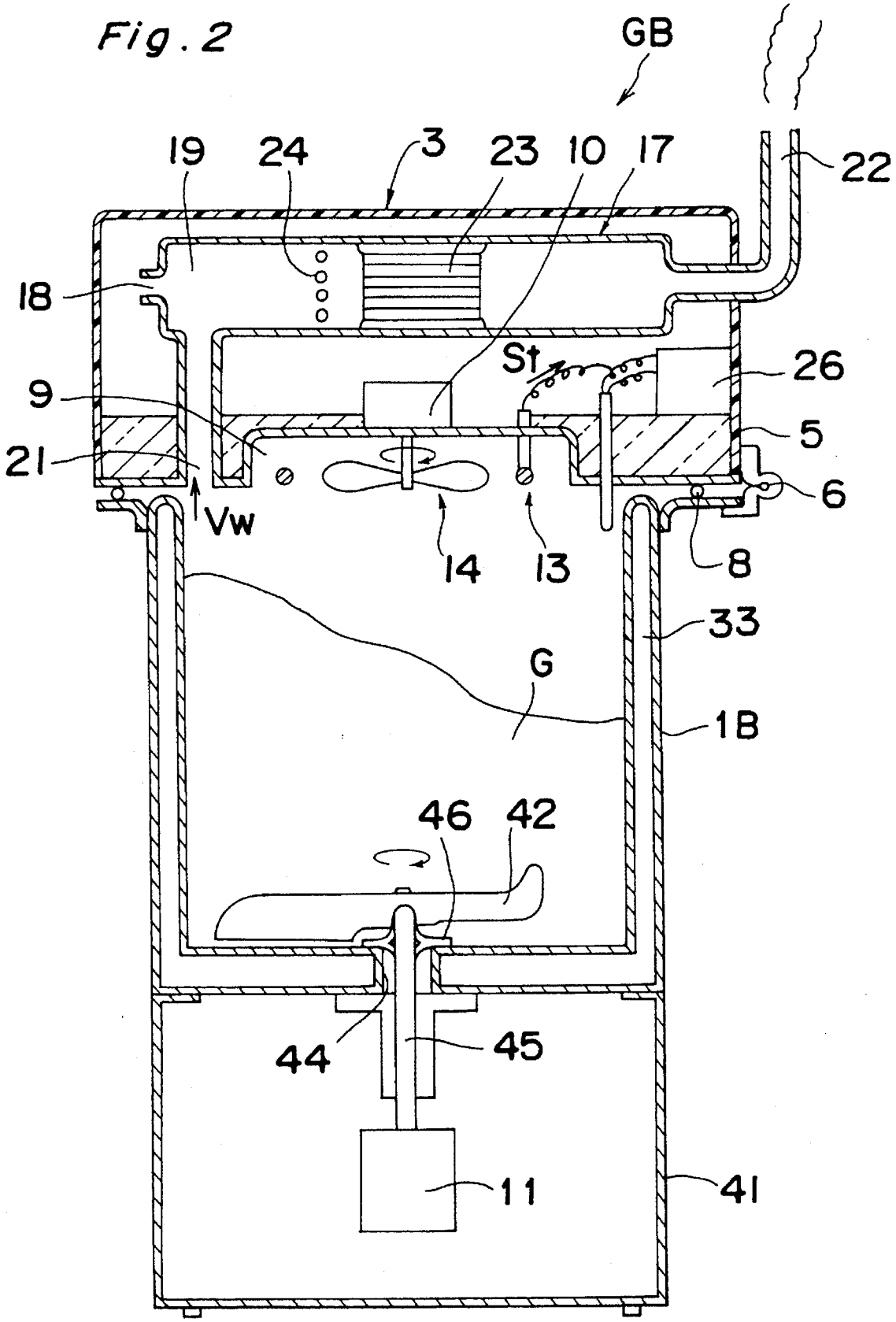
FIG. 2 is a cross-sectional view showing a drying apparatus according to a second embodiment of the present invention.

Referring to FIG. 2, a drying apparatus GB according to a second embodiment of the present invention is shown. A container 1B with the heat insulation space 33 as in the first embodiment is installed above a base 41 vertically in a non-rotational manner. The container 1B is provided with a through hole 44 formed at the center of the bottom thereof, and said through hole 44 has a side wall integrally extending between the inner and outer bottom walls of the container 1B.

A mixing blade 42 is provided in the inner bottom of the container 1B and is connected to the rotary drive unit 11 provided in the base 41 through a motor shaft 45 placed inside the through hole 44. The mixing blade 42 can be rotated by the rotary drive unit 11. Between the motor shaft 45 and hole 44, a seal 46 is provided around the edge of the hole 44 proximal to the blade 42, so that the wet material G, of course, and fluids contained in the wet material G will not leak. These points are what differ from the first embodiment.

The drying apparatus GB of the second embodiment operates essentially the same as that of the first embodiment. Specifically with this embodiment, although the container 1B does not rotate, the wet material G is forcefully mixed by rotation of the mixing blade 42 and is fractionated by a powerful mixing operation. As the result, heating the wet material G is efficient and even more thorough, drying can be made more uniform and the drying time further shortened than in the case of the first embodiment. In addition, the volume of wet material G can be further reduced.

It is to be noted that the above embodiments are described suitable for the case in which raw waste is dried, but by controlling the dry temperature level they can also be used for drying or cooking foodstuffs. By applying a fluororesin or other coating to the inside of the holding container, sticking of process material to the holding container can be prevented.

In addition, the heating means can also be any heat generating body, including a halogen lamp or ceramic heater, other than a sheathed heater.

Third Embodiment

Figure 3:
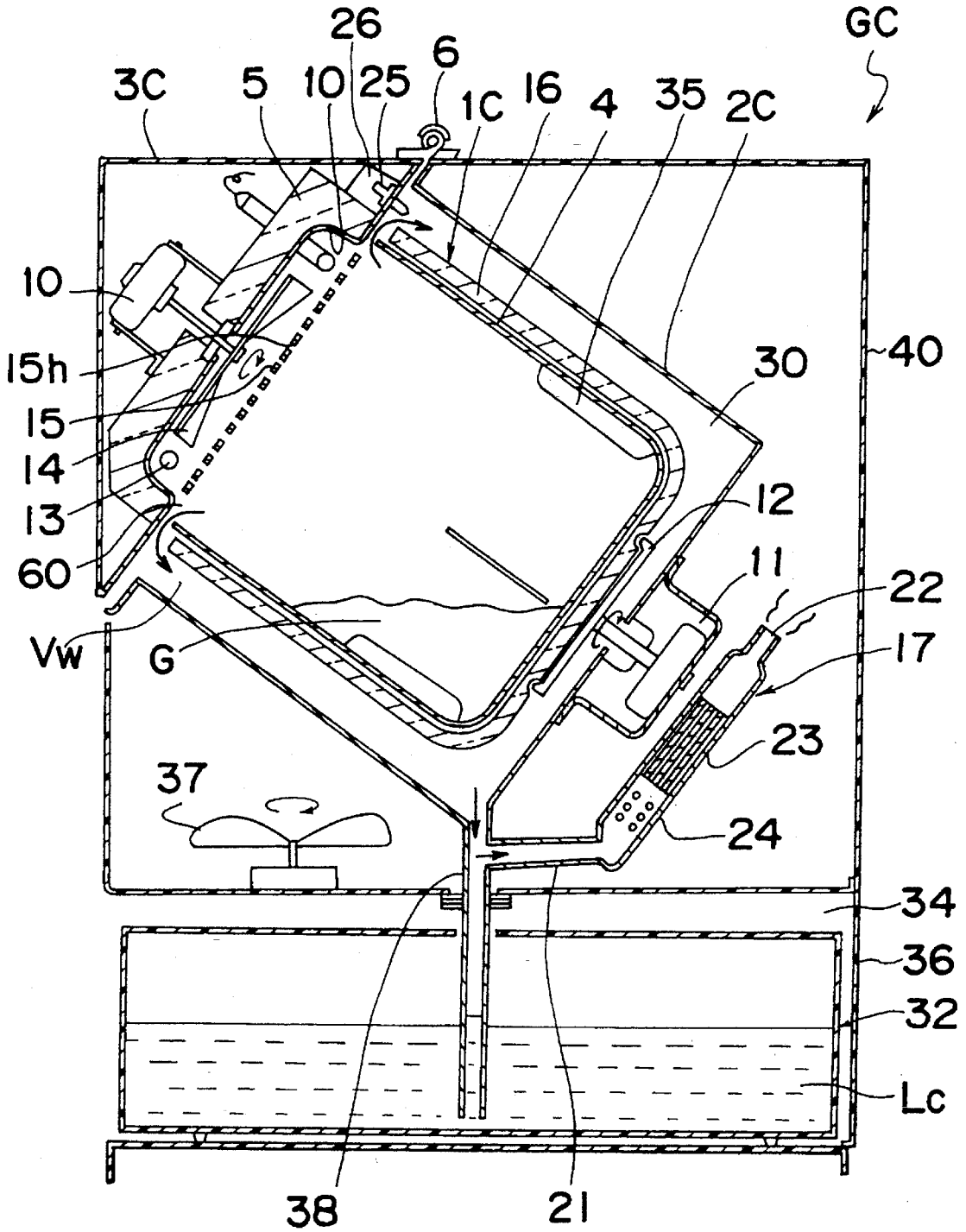
FIG. 3 is a cross-sectional view showing a drying apparatus according to a third embodiment of the present invention.

Referring to FIG. 3, a drying apparatus GC according to a third embodiment of the present invention is shown. In this embodiment, the drying apparatus GC has a construction similar to that of the drying apparatus GA according to the first embodiment. The most significant difference in the construction of this embodiment is that the vapor vent channel 17 is provided not in a cover lid 3C but under the main housing 2C. The main housing 2C also in a tilted posture is housed inside an outer housing 40 formed in a generally box shape.

Furthermore, there is no sealing materials provided between the bottom surface of a cover lid 3C and the open end of container 1C, and a clearance 60 is formed therebetween such that the inside and outside of a container 1C communicate to each other. A (punched) plate 15 is provided under heating unit 13 and air blower 14 for prevent the sticking of wet material G. The (punched) plate 15 has a plurality of perforated holes 15*h* for passing the hot air stream is formed therein. In stead of the mixing member 4 in the first embodiment, a plurality of mixing plates 35 are provided at inner circumferential wall of the container 1C with a predetermined pitch.

A base portion 36 is provided under the outer housing 40 to support the housing 40 with a bottom space 34 between the outer housing 40 and the floor on which the apparatus GC is placed. The base porion 36 is opened at one side for passing a drain liquid tank 32 therethrough such that the drain tank 32 can be placed in the bottom space 34.

The main housing 2C is provided with a drain pipe 38 extending downward from an opening formed in the bottom thereof such that the drain pipe 38 extrudes into the drain liquid tank 32. The vapor vent channel 17 is connected to the side of drain pipe 38 in a tilted posture within the outer housing 40 such that the inlet port 21 communicates with the inside the drain pipe 38 and the outlet port 22 is located diagonally above the inlet port 21.

It is to be noted that the vacuum heat insulation space 33 according to the first embodiment is most suitable for the heat insulation of the container 1C from the view points of size and insulating efficiency. However, a heat insulating material 16 such as heat-resident (foamed) plastics, ceramics, hybrid of metal and plastics-ceramics compounds and double-wall with air heat insulation can be used, as in this embodiment.

A cooling fan 37 is provided inside the outer housing 40 under the tilted main housing 2C so as to blow the air to the bottom side surface of the main housing 2C.

Next, the operation of the drying apparatus GC is described. In a manner similar to that of the first embodiment, the wet material G in the container 1C is heated and repeatedly mixed. Other than fixed projected members or the rotating blade are used to mix the garbage in the above mentioned embodiments, any other suitable means, such as vibration or the mixing blade shown in FIG. 2, can be employed. Generally, the wet material G gets a high temperature at the portion near the heat source and a low temperature at the container's wall side which is remote from the heat source. However, since the container 1C is well insulated thermally in this embodiment, the heat is distributed in the wet material G uniformly so that the whole part of wet material G is dried evenly. Furthermore, the power loss depending on the heat loss through the wall of container 1C is well suppressed by the employment of insulating material 16, resulting in a high thermal efficiency of the apparatus GC.

To fill the container 1C with the dried vapor Vw having a lowered relative humidity, the temperature controller 26 controls the heating unit 13 such that the temperature of water vapor Vw from the wet material G detected by the temperature detector 25 is greater than 100° C . Thus obtained dried water vapor Vw is agitated by the fan of air blower 14, and some portion of agitated vapor Vw is used to cool the heating unit 13. It is to be noted that the heater should be kept at a temperature grater than that of the vapor, otherwise the heat can not be transmitted from the heater unit to the vapor. It is also effective to rotate the container 1C or mixing blade shown in FIG. 2 and the fan 14 in the opposite directions to shorten the period required for the drying process.

For example, to vaporize 1 Kg of water for one hour by the hot water vapor Vw which is heated up to 130° C., the heating unit 13 should be run with output of 600 W and the temperature at the surface thereof indicates 320° C. When organic matter such as carbohydrorate and protein included in the wet material G is blown to stick to the heating unit 13, this organic matter begins the thermal decomposition at approximately 350° C. with strong bad odor. Since the blowing of the wet material G (organic matter) can not be prevented during the drying process, the heating unit 13 should be preferably controlled at temperature lower than 350° C. but higher than 100° C. Also, fining the perforated holes 15*h* can reduce the sticking of the wet material G to the heater unit 13, but is limited to prevent the clogging thereof by the blown wet material G.

To prevent the heating unit 13 from reaching an extremely high temperature, the small amount of electric power should be preferably supplied to the heating unit 13. A great amount of radiant heat is released from the heater at a high temperature of the heating unit 13. However, almost all of thus released radiant heat is absorbed by the fan of the air blower 14 and a recessed circumferential wall 10 of cover lid 3C, and only the rest of the released radiant heat directly heats the wet material G. It is to be noted that insulation materials 5 and 16 provided on the back side of the recessed circumferential wall 10 and container 1C prevent thus absorbed heat from losing to the outside of the apparatus GC. Thus, the temperature reduction of vapor Vw is prevented, so that the extremely high temperature of the heating unit 13 caused by the excessive supply of power due to the heat loss can be prevented.

From the view points of the heat transmission, the material for the recessed circumferential wall 10 preferably has the radiation rate lower than that of the surface of fan 14. And, the heater of the heating unit 13 is preferably formed in a circular shape extending around the fan (air blower) 14. Pursuant to this purpose, the fan 14 is preferably made or coated by a material which absorbs the infrared ray, and the recessed circumferential wall 10 is preferably made or coated by a material which reflects the infrared ray.

The vapor Vw produced by heating as described above flows from the container 1C to a condensation chamber 30 which is a space formed between the container 1C and the main housing 2C through the clearance 60. Since the condensation chamber 30 is thermally insulated by the insulating material 16 from the heat in the container 1C, the water vapor Vw is cooled and condensed to a liquid Lc (water). The cooling fan 37 is also controlled by the controller 26 to blow the air to the main housing 2C for cooling the condensation chamber 30 based on the temperature signal St. In this embodiment, the controller 26 is used for the control of the cooling fan 37, but any suitable control means other than the controller 26 can be used.

Since the water vapor Vw vaporized at about 100° C. includes the smelling components which can be vaporized at the same temperature, the liquid Lc thus condensed by cooling to the room temperature in the condensation chamber 30 comprises the water and smelling components at the same rate of that in the water vapor Vw. In other words, according to the present invention, almost all odor generated through the drying process can be exhausted to the liquid tank 32 through the pipe 18 as in a liquid but not in a gas. The liquid tank 32 can be taken out from the drying apparatus GC for discharging the liquid Lc filled therein.

The rest of water vapor Vw not condensed in the condensation chamber 30 is lead to the vapor vent channel 17, in which the water vapor Vw is deodorized by the catalyst 23 and exhausted from the outlet port 22 in the same manner as in the first embodiment. Since substantial amount of moisture in the water vapor Vw is already removed by the condensation chamber 30, only a little amount of moisture enters in the channel 17. Therefore, the water vapor Vw reacts with the catalyst 23 free from the poisoning by the moisture even when the activated carbon or oxidation catalyst is used for the catalyst 23, and the deodorization of the vapor is improved.

In this embodiment, the drying apparatus is constructed compact such that the vaporization is performed in the container 1C with the condensation chamber 30 surrounding therearound. Furthermore, the container 1C is detachable for the convenience of the cleaning the apparatus GC.

Figure 4:
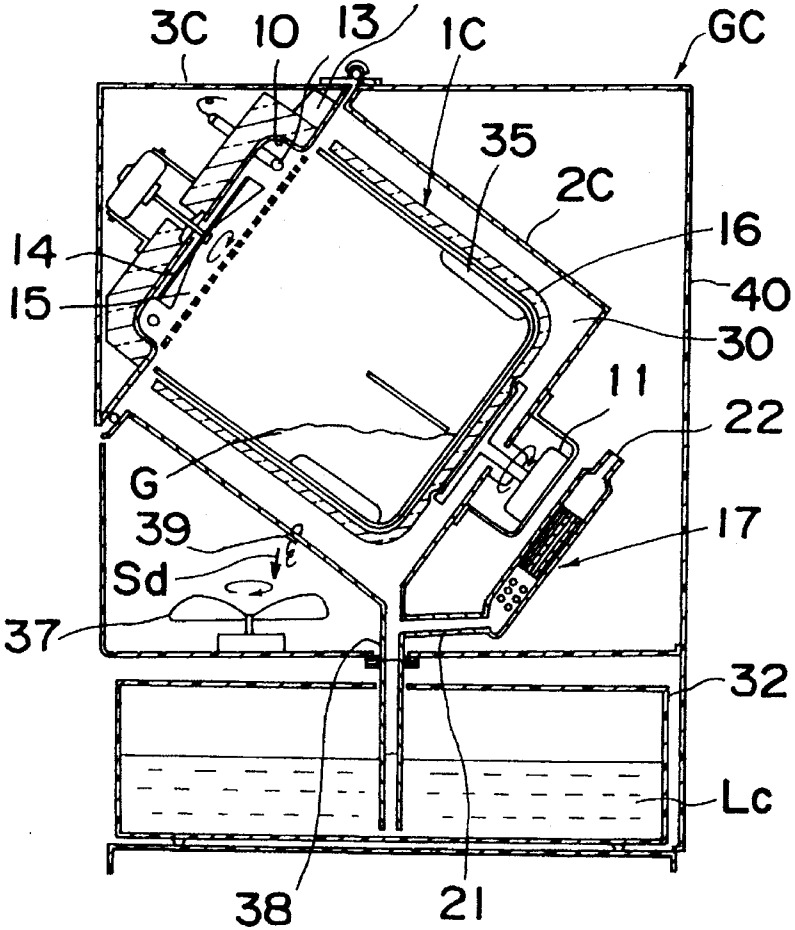
FIG. 4 is a cross-sectional view showing a modification of the drying apparatus of FIG. 3.

Referring to FIG. 4, a modification of drying apparatus according to the third embodiment is shown. In this modification, the drying apparatus GC further has a condensation chamber temperature detector 39 provided inside the condensation chamber 30 for detecting the temperature therein. The temperature detector 39 produces a temperature signal Sd based on the detected temperature and is connected the controller 26. The controller 26 controls the operations of the cooling fan 37 based on the temperature signal Sd and the operations of the heating unit 13 based on the temperature signal St, so that the condensation chamber 30 is kept at predetermined temperature. The catalyst 26 is comprised of oxidation catalyst such as platinum group metals are used as supported by ceramic base formed in a honeycomb construction, and is heated up to a temperature of 300° C. or greater so as to activate the catalytic reaction.

The operation of the drying apparatus GC according to this modification is as follows. As the drying process proceeds, the wet material G is covered by the dried surface lawyer which is a good heat insulating material. As a result, the heat can not be conveyed into the wet material G very well so that the amount of the water vapor Vw generated from the wet material G is reduced. At this time, to break this dried surface layer and convey heat into inside the wet material G, the rotary drive unit 11 is operated to rotate the container 1C for mixing the wet material G.

The wet material G comprised of mainly foodstuffs contains moisture of about 80% of its weight. In this case, since the wet material G still keeps amount of moisture enough for vaporization at the surface thereof, the mixing is not necessary until when the average moisture content of the wet material G is reduced to about 75%.

By the rotation of the container 1C, the wet material G is mixed by the plate 35 so that the dried surface layer is broken and replaced by the inner portion of wet material G. From wet portion of the wet material G replaced on the top thereof, water vapor Vw is produced again. However, replaced wet portion of the wet material G is also dried in extremely short period such as about 30 seconds to 2 minutes, resulting in the reduction of the drying speed. Therefore, it is preferable that the container 1C with the material G is rotated 1 to 10 times for this drying interval of about 30 seconds to 2 minutes.

In case that the mixing operation is not enough, it takes a long time for drying the wet material G. In case of that the mixing is excessive, wet material G becomes in a plurality of lumps, especially when heating the foodstuffs including such a starch which thermally changes to α-starch. It is impossible to dry the inside of lumped material G. The wet material G whose surface is dried has no adhesive ability. When the wet material G contains thus lumped portions having dried surface and non-lumped portions, such wet material G is broken at those dried portions by the mixing operation, and is not easily dispersed into small portions.

It is to be noted that the time for mixing operation should be less than the interval between each mixing operation to prevent the lumping of the wet material G caused by an insufficient period for drying the surface of material G. At the final stage of drying operation, wet material G becomes light in weight so that fine particles thereof are easily carried about by the air blows. In addition to the filtration effect by the the plate 15, stopping the air blower 14 during the mixing operation can reduce flying about of wet material G and can prevent the wet material G from sticking to the air blower 14 and the heating unit 13.

As the drying process further proceeds, the wet material G which is a mixture of various foodstuffs, looses the ability adhesive to each other when the moisture contents therein reaches about 40%. In this case, the wet material G is continually mixed without intermittence for increasing the drying speed. As from the above, the mixing operation is performed at three different modes according to the moisture contents of the wet material G. First is a non-mixing mode for the period while the moisture content reduces to 75%, at which the wet material G is not mixed. Second is an intermittent mixing mode for the period while the moisture content varies from 75% to 40%, at which the wet material G is repeatedly mixed with a predetermined interval. Third is an continual mixing mode for the period while the moisture content reduces from 40%, at which the wet material G is mixed continually.

The condensation heat generated when the water vapor Vw is condensed in the condensation chamber 30 is used to keep the container 1C hot against the cool external environment. The water vapor Vw varies its condition according to the position with respect to the condensation chamber 30 as follows. At the top portion of the chamber 30, the vapor is hot and dry and has a temperature of about 130° C. At the middle portion, the vapor Vw releases the condensation heat and keeps a temperature of 100° C. At the bottom portion, the vapor Vw becomes saturated in a foggy state having a temperature of 40° C.

Since the highest temperature that wet material G can reach is 100° C., or 105° C. even when the wet material G includes salts therein, water vapor Vw works to keep the temperature of the wet material G from the top to the middle part thereof. In addition, the insulation material 16 provided on the outer side surface of the container 1C increases the temperature keeping ability of the apparatus GC. The low part of the the wet material G is heavy due to the plenty of moisture content therein, and is hard to cool down thanks to the above temperature keeping ability. Thus, the bottom part of the wet material G keeps a temperature high enough to vaporize the moisture when exposed to the dried hot air blow by mixing operation. Furthermore, the wet material G sticking to the inner side wall of the container 1C has also a high temperature, and is kept in such a condition that the sticking material G is easily dried by the contact with the mixed material G having a temperature of 130° C.

Figure 5:
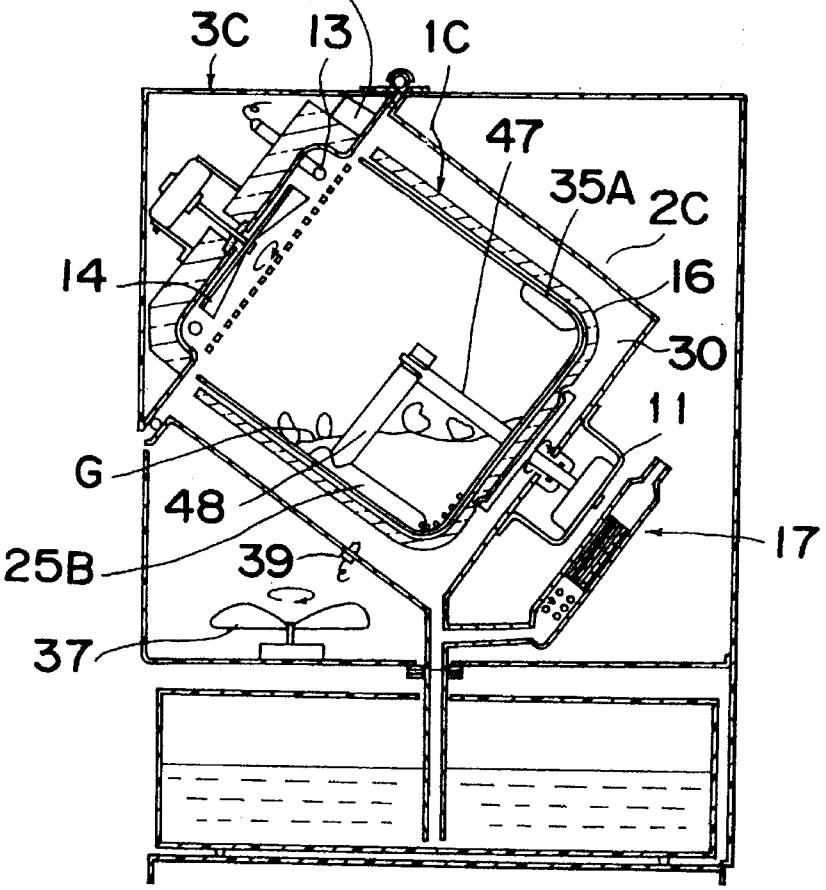
FIG. 5 is a cross-sectional view showing another modification of the drying apparatus of FIG. 3.

Referring to FIG. 5, a modification of drying apparatus of FIGS. 2 and 4 is shown. In FIG. 2, the mixing blade is connected to the motor shaft 45 which is driven by a motor. In FIG. 5, a clutch means is provided between the mixing blade and the motor. In this modification, a plurality of mixing plates 35 are replaced by a short mixing plate 35A and a long mixing 35B. These mixing plates 35A and 35B are provided at an opposite positions on the inner side near the bottom of the container 1C. The container 1C is further provided with a vertical shaft 47 at the center of the inner bottom surface thereof. A hammer 48 is provided at the free end portion of the vertical shaft 47 such that hammer 48 can freely rotate with respect to the vertical shaft 47. As the container 1C rotates, the hammer 48 is raised up by the long mixing plate 35B from the bottom to the peak position, rotating by 180° . At next moment, the hammer 48 falls down by it's own weight, rotating down by 180° . passing above the short mixing plate 35A. Since the hammer 48 is preferably provided a heavy weight on it's free end, the hammer 48 can strongly break the wet material G positioned in the rotation path. The hammer 48 once fell down stays at the bottom position until when the long mixing plate 35B returns again. Thus, the broken portion of the material G is moved downward to mix with the inner portion, so that the wet material G which is light and bulky do not to hamper the drying process of the entire of wet material G.

Figure 6:
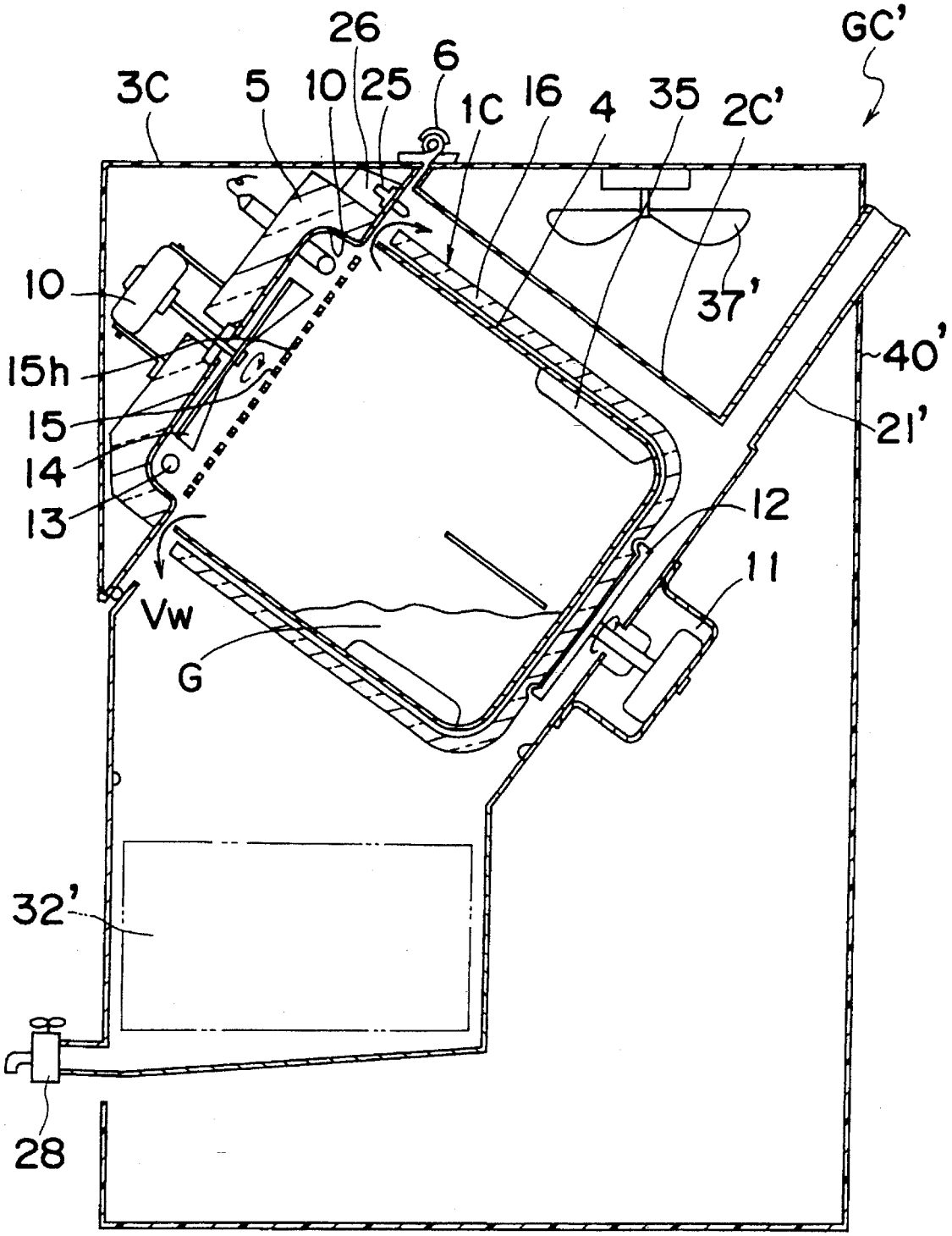
FIG. 6 is a cross-sectional view showing further another modification of drying apparatus of FIG. 3.

Referring to FIG. 6, further another modification of drying apparatus of FIG. 3 is shown. In this modification, a drying apparatus GC' does not have the liquid tank 32 and the base portion 36, but has a modified main housing 2C'. The modified main housing 2C' has a bottom portion extended downward to form a liquid pocket 32' above the bottom of an outer housing 40' for reserving the condensed liquid Lc therein. The liquid pocket 32' is provided with an outlet valve 28 for the convenience of discharging the liquid Lc outside. It is also possible to use a suitable-sized liquid tank, indicated by an imaginary line, for receiving the condensed liquid Lc therein by placing the liquid tank in the liquid pocket 32' through the cover lid 3C opened. Although the vapor vent channel 17 and cooling fan 37 are removed, but a main housing 2C' is provided with a pipe 21' connected to the top bottom portion thereof for leading out the non-condensed water vapor Vw therethrough, as shown in FIG. 6. It is needless to say that thus removed channel 17 and fan 37 can be provided inside the drying apparatus GC' as in the above described embodiments.

Fourth Embodiment

Figure 7:
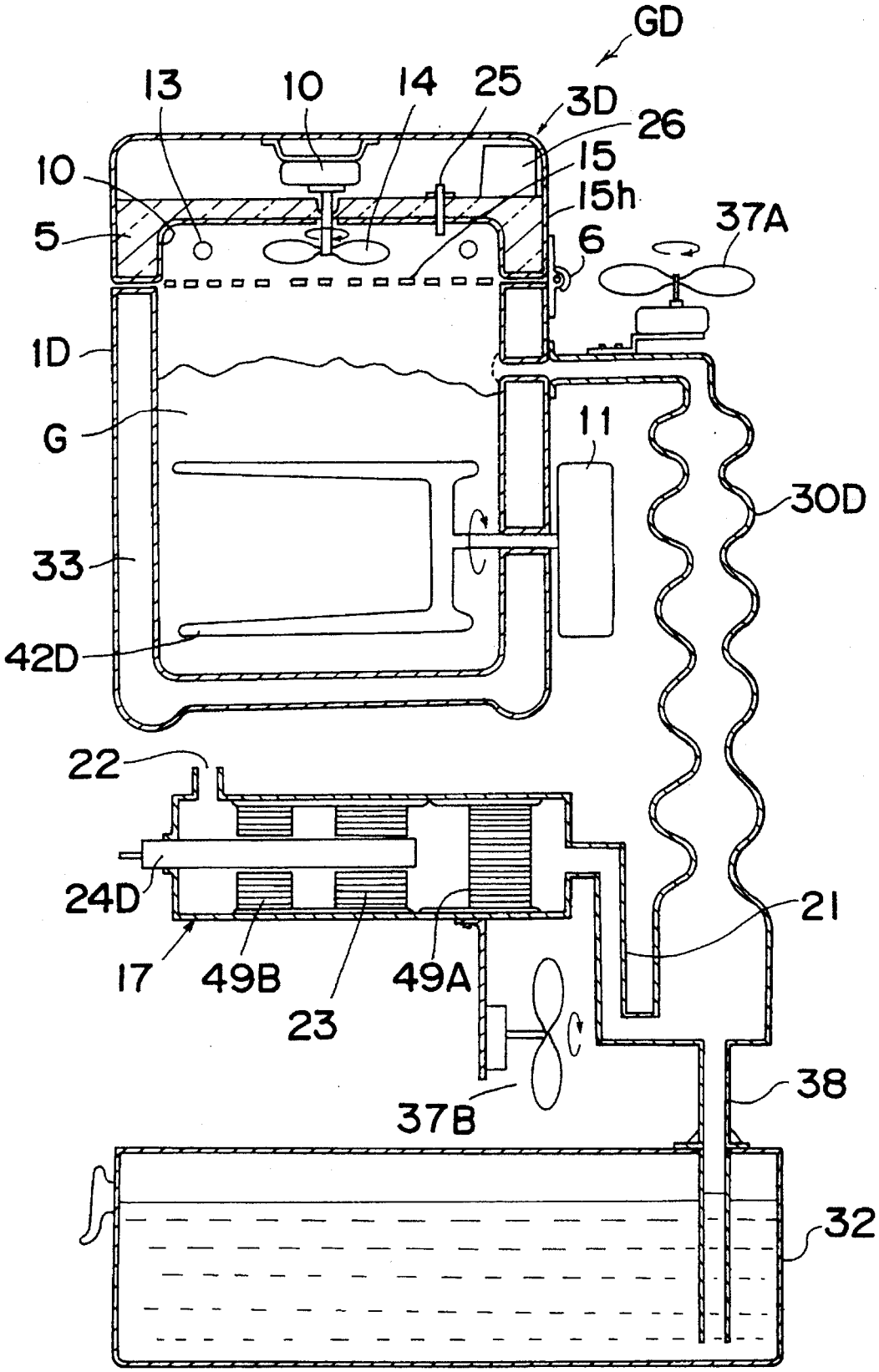
FIG. 7 is a cross-sectional view showing a drying apparatus according to a fourth embodiment of the present invention.

Referring to FIG. 7, a drying apparatus according to a fourth embodiment of the present invention is shown. Similarly, the drying apparatus GD has a container 1D, a cover lid 3D, a condensation chamber 30D, a vapor vent channel 17D, and the liquid tank 32. In this embodiment, the cover lid 3D and container 1D are firmly mated in an airtight manner so as to define an vaporization chamber in which the moisture in the wet material G is vaporized. However, the container 1D is provided with a mixing fork 42D at the inner side wall thereof. The mixing fork 42D has two parallel blades and is connected to the rotary drive unit 11 through the sealed hole formed in the side wall of the container 1D so that the mixing fork rotates along a horizontal axis.

The condensation chamber 30D communicates with the inside of thus formed vaporization chamber and horizontally extends from the upper side porion of the container 1D by a predetermined length and then further extends downward. The drain pipe 38 provided on the bottom end of the condensation chamber 30D enters into the liquid tank 32 placed therebelow. A first cooling fan 37A for blowing an air toward the condensation chamber 30D extending downward is provided above thus formed horizontally extended porion of the chamber 30D. The first cooling fan 37A is connected to and controlled by the controller 26.

The vapor vent channel 17D is connected to the bottom portion of the condensation chamber 30D through the inlet port 21. The channel 17D is located at the position above the bottom of the condensation chamber 30D to prevent the condensed liquid Lc from flowing therein. A second cooling fan 37B is provided beside the bottom portion of condensation chamber 30D for blowing an air toward the inlet port 21 and is also controlled by the controller 26. In this embodiment, the controller 26 is used for the control of the cooling fans 37A and 37B, but any suitable control means other than the controller 26 can be used.

The description herein below is directed to the advantageous effect commonly observed in the embodiments of FIGS. 3 and 7. Note that the effect described below is will not be observed in the case where the intake opening 18 (FIG. 1) is provided.

The vapor vent channel 17D has front and back regenerative heat exchangers 49A and 49B formed by honeycomb structured metal or ceramics provided beside the inlet port 21 and the outlet port 22, respectively. Between the regenerative heat exchangers 49A and 49B, the oxidation catalyst 23 is provided. The heater 24D is provided for heating the catalyst 23 and the back regenerative heat exchanger 49B, as best shown in FIG. 7.

It is to be noted that the catalytic reaction is suppressed both when the water vapor Vw contains little amount of oxygen and when the catalyst 23 absorbs the liquid (water) so much. To avoid these problem, according to this embodiment, the internal pressures in the vaporization chamber and the condensation chamber 30D are controlled as follows.

When the power for heating the wet material G is increased, the internal pressure of the vaporization chamber is increased, causing the gaseous stuffs in the vapor vent channel 17D to exhaust from the outlet port 22. Thus exhausted gaseous stuffs is already deodorized by the catalyst 23 before exhausting from the outlet port 22.

When the heating the wet material G is stopped, the vaporization is stopped. However, the condensation of the water vapor Vw resident in the condensation chamber 30D does not stop simultaneously and continues. As the condensation of the water vapor Vw, the internal pressure of the condensation chamber 30D is reduced to a negative side. In this case, the outside air enters in the channel 17D from the outlet port 22 and flows toward the condensation chamber 30D. By repeating this cycle, the condensation chamber 30D is supplied with the oxygen included in the outside atmosphere, and thus supplied oxygen is further fed to the bottom portion of the chamber 30D to which the inlet port 22 is connected. Thus, the oxygen enough for the catalytical reaction is always prepared therebefore. Furthermore, the outside air moving within the channel 17 promotes the catalyst 23 to be dried.

Mixing the wet material G intermittently is also effective to control the internal pressures in the vaporization chamber and the condensation chamber 33D, as described below. Keeping the wet material G being heated by the heating unit 13 causes the surface of the wet material G dried. Due to this dried surface, the speed of vaporization from the wet material G is reduced, so that the internal pressure in the vaporization chamber is reduced.

When the temperature at the dried surface of the wet material G reaches about 130° C. which is the same as that of the water vapor Vw, the mixing fork 42D is operated such that the dried surface portion and the wet bottom portion of the wet material G are mixed together. As a result of this mixing, the vaporization from the wet material G increases so that the internal pressure of the vaporization chamber is increased. By repeating this operation, the internal pressure in the vaporization chamber changes between positive and negative sides, and the oxygen enough for catalytic reaction is supplied to the catalyst 32 from the outside.

Furthermore, cooling the condensation chamber 30D by the first cooling fan 17A is effective for oxygen supply to the catalyst 23. By operating the cooling fan 37A to promote the vapor condensation in the chamber 30D with a constant vaporization speed of the wet material G, the internal pressure in the condensation chamber 30D is reduced. Then, the outside air is taken in passing through the catalyst 32. Next, the condensation is stopped by stopping the cooling fan 37A so as to increase the internal pressure in the condensation chamber 32D, causing thus taken outside air to move to the outside through the catalyst 32. According to this method, since the vaporization is continually performed, the higher drying speed is obtained. However, the condensation chamber 30D should have a great capacity so as to make the temperature of vapor Vw exiting therefrom has a lower temperature even when the condensation operation is stopped.

In general, the catalyst becomes more active at higher temperature. Therefore, also in this embodiment, the catalyst 23 is heated by the heater 24D. However, the outside air is moved around the catalyst 23 and the catalyst 23 is cooled down. Thus, the heat of the catalyst 23 and the heater 24D is lost. To recover the heat loss, the regenerative heat exchanges 49A and 49B are provided before and behind the catalyst 23, respectively, as best shown in FIG. 7. The back heat exchanger 49B takes and accumulates the heat from the hot vapor Vw having a high temperature before exhausting from the outlet port 22, and then heats the outside air coming into the channel 17 through the outlet port 22 by thus accumulated heat. When the outside air enters in the channel 17, the heat at the catalyst 23 moves toward the condensation chamber 30D. This moved heat of the catalyst 23 is recovered by the front heat exchanger 49A when the vapor Vm is exhausted. By adding the catalyst to these heat exchangers 49A and 49B, the exhausted vapor can be well deodorized.

Furthermore, the second cooling fan 37B is operated to cool around the inlet port 21, otherwise the heat at the catalyst 23 enters into the condensation chamber 30D and the temperature inside the condensation chamber 30D rises, resulting in the reduction of condensing ability. Thus, the catalyst 32 is protected from the vapor Vw with high moisture content.

Figure 8:
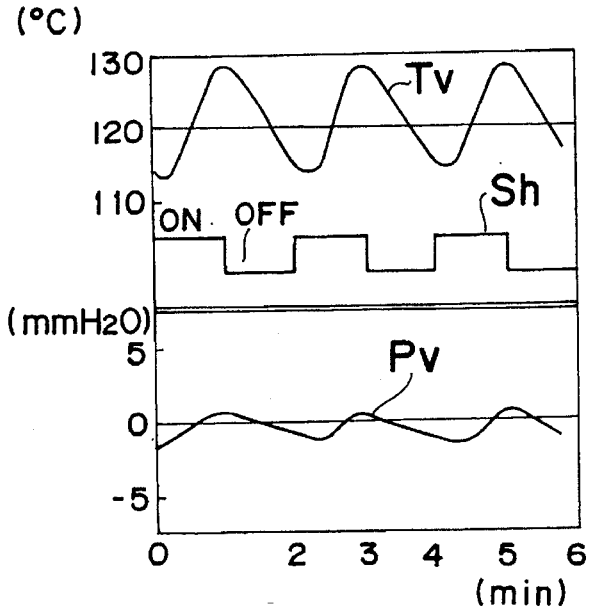
FIG. 8 is a graph of assistance in explaining a relationship between the temperature and internal pressure of the container with respect to the heating operation according to the present invention.

Referring to FIG. 8, a graph for assistancing in explaining a relationship between the temperature and internal pressure of the vaporization chamber with respect to the operation of heating unit 13 is shown. In this graph, signals Tv, Sh, and Pv represent the temperature in the vaporization chamber, the operation of heating unit 13, and the internal pressure of the vaporization chamber, respectively. The temperature Tv of the vaporization chamber varies in accordance with ON/OFF operation of the heating unit 13. These variations of the temperature Tv also cause the vaporization speed to vary, resulting in the variation of the internal pressure Pv. When the internal pressure Pv is negative the outside air is taken in toward the catalyst 23. When positive, the vapor Vw mixed with the thus taken in outside air is exhausted from the outlet port 22.

Figure 9:
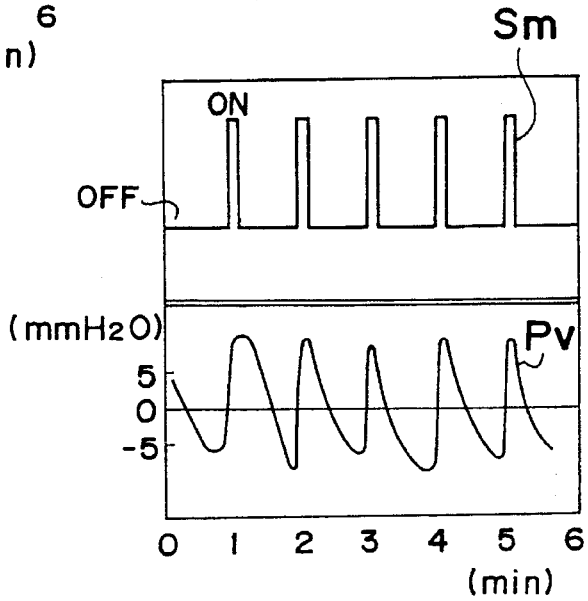
FIG. 9 is a graph of assistance in explaining a change of internal pressure of the container with respect to the mixing operation according to the present invention.

Referring to FIG. 9, a graph of assistance in explaining a change of internal pressure of the container with the operation of mixing blade 13 is shown. In this graph, signals Sm, and Pv represent the operation of mixing unit 42D and the internal pressure of the vaporization chamber, respectively. According to the Turn ON/OFF operation of the mixing unit 42D, the internal pressure Pv varies in a manner similar to that shown in FIG. 8.

Figure 10:
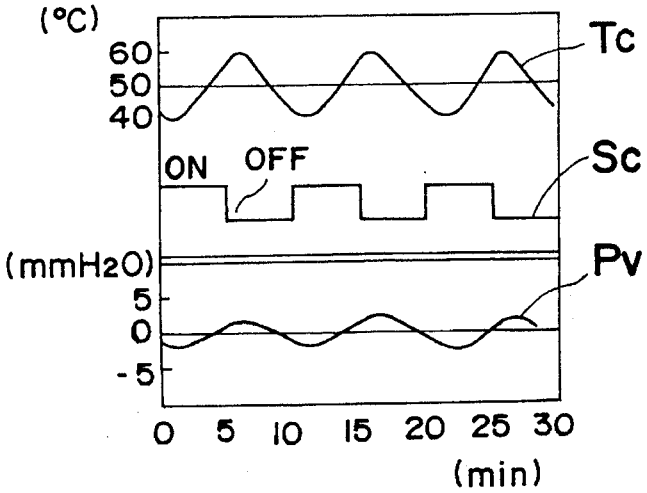
FIG. 10 is a graph of assistance in explaining a relationship between the temperature and internal pressure of the container with respect to the cooling operation according to the present invention.

Referring to FIG. 10, a graph of assistance in explaining a relationship between the temperature and internal pressure of the container with respect to the operation of cooling is is shown. In this graph, signals Tc, Sc, and Pv represent the temperature in the condensation chamber 30D, the operation of cooling unit 37A, and the internal pressure of the vaporization chamber, respectively. Similarly, according to Turn ON/OFF operation of the cooling unit 37A, the internal pressure Pv varies.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A drying apparatus for drying a material, the apparatus comprising:

a material-receiving container;

hot air stream generation means provided inside said container for producing a heated air stream inside said container to vaporize moisture in material received in said container into a vapor;

mixing means for mixing material received in said container so as to increase exposure of the material to said heated air stream;

a vapor vantilation channel communicating an inside of said container with an outside of said container; and wherein said hot air stream generation means comprises a heater, means for heating the surface of said heater within a range between a first predetermined temperature and a second predetermined temperature greater than said first predetermined temperature so as to heat air to produce heated air, and fan means for moving the heated air to produce the heated air stream.

2. A drying apparatus as claimed in claim 1, wherein said ventilation means comprises:

air mixing means for mixing the vapor with outside air to produce an air-vapor mixture; and oxidation catalyst means for catalytically processing the air-vapor mixture before venting.

3. A drying apparatus as claimed in claim 1, wherein said mixing means comprises rotating means provided on the bottom of said container means for rotating said container about a rotational axis.

4. A drying apparatus as claimed in claim 1, wherein said mixing means comprises a material-stirring member provided inside said container.

5. A drying apparatus as claimed in claim 1, wherein said heating means is operable to cause said heater to heat the air stream to a temperature of 100° C. or more.

6. A drying apparatus as claimed in claim 1, wherein said mixing means comprises:

a rotating blade rotatably mounted in said container; and rotation means for rotating said rotating blade to stir the material.

7. A drying apparatus as claimed in claim 1, wherein said container comprises:

a cylindrical housing having a material-receiving opening and a top cover operably mounted over said material-receiving opening of said cylindrical housing.

8. A drying apparatus as claimed in claim 1, further comprising mixing control means for controlling operation of said mixing means.

9. A drying apparatus as claimed in claim 8, wherein said mixing control means controls said mixing means to mix said material intermittently.

10. A drying apparatus as claimed in claim 9, wherein said mixing control means controls said mixing means to operate such that intervals between periods of mixing are longer than the periods of mixing, respectively.

11. A drying apparatus as claimed in claim 10, further comprising heating control means for controlling operation of said hot air stream generation means.

12. A drying apparatus as claimed in claim 11, wherein said heating control means operates in cooperation with said mixing control means.

13. A drying apparatus as claimed in claim 12, wherein said hot air stream generation means is controlled to not operate while said mixing means is controlled to operate and said hot air stream generation means is controlled to operate while said mixing means is controlled to not operate.

14. A drying apparatus as claimed in claim 1, wherein said container has a wall formed by a heat insulation wall.

15. A drying apparatus as claimed in claim 14, wherein said heat insulation wall is formed by a vacuum space.

16. A drying apparatus as claimed in claim 1, wherein said first predetermined temperature is 100° C. and said second predetermined temperature is 350° C.

17. A drying apparatus for drying a material including moisture, said apparatus comprising:

a material receiving container;

hot air stream generation means provided inside said container for producing a heated air stream inside said container to vaporize moisture in material received in said container into a vapor;

a vapor ventilation channel communicating an inside of said container with an outside of said container; and mixing means for mixing the material received in said container so as to increase exposure of the material to said heated air stream, said mixing means comprising rotating means provided on a bottom of said container for rotating said container about said rotational axis, wherein said mixing means further comprises:

a shaft provided inside said container at a bottom thereof and extending along said axis;

a hammer arm rotatably mounted on said shaft;

a first mixing plate provided on the inner circumferential side of said container and adjacent the bottom of said container to receive a free end of said hammer arm; and a second mixing plate provided on the inner circumferential side of said container and opposite said first mixing plate, said second mixing plate being shorter than said first mixing plate whereby when said container is rotated, said hammer arm is lifted up to a peak position by said first mixing plate and then falls down due to gravitational force to stir the material.

18. A drying apparatus for drying a material, said apparatus comprising:

a material receiving container;

hot air stream generation means provided inside said container for producing a heated air stream inside said container to vaporize moisture in material received in said container into a vapor;

mixing means for mixing the material received in said container so as to increase exposure of the material to said heated air stream;

a vapor ventilation channel communicating an inside of said container with an outside of said container;

wherein said heated air stream generation means comprises a heater, and fan means for moving air heated by said heater to produce the heated air stream; and wherein said fan means is comprised of a material having a heat radiation rate greater than that of a material of said container adjacent said fan means.

19. A drying apparatus for drying a material, said apparatus comprising:

a material receiving container;

hot air stream generation means provided inside said container for producing a heated air stream inside said container to vaporize moisture in material received in said container into a vapor;

mixing means for mixing the material received in said container so as to increase exposure of the material to said heated air stream;

a vapor ventilation channel communicating an inside of said container with an outside of said container;

said heated air stream generation means comprises a heater, and fan means for moving air heated by said heater to produce the heated air stream; and wherein said fan means rotates in a first direction reverse to a second direction in which said container rotates for a predetermined period during operation.

20. A drying apparatus for drying a material, said apparatus comprising:

a material receiving container;

hot air stream generation means provided inside said container for producing a heated air stream inside said container to vaporize moisture in material received in said container into a vapor;

mixing means for mixing the material received in said container so as to increase exposure of the material to said heated air stream;

a vapor ventilation channel communicating an inside of said container with an outside of said container;

a housing, said container being mounted in said housing, and a space being formed between said housing and said container, said space constituting a condensation chamber;

heat insulating means provided in said container for reducing heat transmission from said container to said condensation chamber; and vapor pass means for passing vapor generated in said container to said condensation chamber so that the vapor is condensed to a liquid in said condensation chamber.

21. A drying apparatus as claimed in claim 20, further comprising:

drain means provided at the bottom of said condensation chamber for draining the liquid therefrom.

22. A drying apparatus as claimed in claim 21, further comprising a tank means for storing the liquid drained by said drain means.

23. A drying apparatus for drying a material, said apparatus comprising:

a material receiving container;

hot air stream generation means provided inside said container for producing a heated air stream inside said container to vaporize moisture in material received in said container into a vapor;

mixing means for mixing the material received in said container so as to increase exposure of the material to said heated air stream;

a vapor ventilation channel communicating an inside of said container with an outside of said container;

mixing control means for controlling operation of said mixing means;

wherein said mixing control means controls said mixing means to not operate at an initial stage of the drying process, and to operate intermittently during a middle stage of the drying process;

wherein said mixing control means controls said mixing means to operate during the middle stage of the drying process such that intervals between periods of mixing are longer than the periods of mixing, respectively;

wherein heating control means is provided for controlling operation of said hot air stream generation means; and wherein said heating control means operates in cooperation with said mixing control means.

24. A drying apparatus for drying a material, said apparatus comprising:

a material receiving container;

hot air stream generation means provided inside said container for producing a heated air stream inside said container to vaporize moisture in material received in said container into a vapor;

mixing means for mixing the material received in said container so as to increase exposure of the material to said heated air stream;

a vapor ventilation channel communicating an inside of said container with an outside of said container;

cooling means for cooling said condensation chamber;

temperature detection means for detecting a temperature in either one of said condensation chamber and another portion adjacent said condensation chamber and producing a temperature signal indicative said detected temperature;

cooling control means operable in response to said temperature signal for controlling operation of said cooling means, whereby when said detected temperature is greater than a predetermined temperature, said cooling means is operated;

mixing control means for controlling operation of said mixing means;

wherein said mixing control means controls said mixing means to mix said material intermittently, and such that intervals between periods of mixing are longer than the periods of mixing, respectively;

wherein heating control means is provided for controlling operation of said hot air stream generation means; and wherein said heating control means operates in cooperation with said mixing control means.

25. A drying apparatus as claimed in claim 24, wherein said cooling control means operates in cooperation with said mixing control means and said heating control means.

26. A drying apparatus for drying a material including moisture, said apparatus comprising:

a vaporization container formed in an airtight manner for receiving the material;

heating means provided inside said vaporation container for heating the material at a temperature greater than a boiling temperature of the moisture to produce a vapor therefrom;

condensing means having an open first end and an open second end, said first end being connected to said vaporization container for taking the vapor therefrom and condensing the vapor into a liquid;

an oxidation catalyst device having inlet and outlet ports and a catalyst provided between said inlet and outlet ports, said inlet port being connected to said second end of condensing means in an airtight manner for taking said vapor therethrough, said outlet port being open to the outside; and control means changing either one of vapor producing speed in said vaporization container and vapor condensing speed in said condensing means.

27. A drying apparatus as claimed in claim 26, wherein said control means controls said vapor producing speed by changing a heating speed of said heating means.

28. A drying apparatus as claimed in claim 26, further comprising mixing means for mixing the material, said mixing means being operated intermittently to change said vapor producing speed.

29. A drying apparatus as claimed in claim 26, further comprising first cooling means provided beside said condensing means for forcibly cooling said condensing means, said first cooling means being operated intermittently to change said vapor condensing speed.

30. A drying apparatus as claimed in claim 26, wherein said oxidation catalyst device comprises:

heater means for heating and activating said catalyst; and first regenerative heat exchanging means provided between said catalyst and said outlet port for recovering heat lost thereat.

31. A drying apparatus as claimed in claim 30, wherein said oxidation catalyst device further comprises:

second regenerative heat exchanging means provided between said catalyst and said outlet port for recovering heat lost thereat.

32. A drying apparatus as claimed in claim 26, further comprising:

heater means provided in said oxidation catalyst device for heating and activating said catalyst; and a second cooling means provided beside said inlet port for forcibly cooling said condensing means to reduce the moisture in the vapor by condensing the vapor before it enters into said oxidation catalyst device.

33. A drying apparatus as claimed in claim 26, wherein said oxidation catalyst device has an opening; and a heater means is inserted in said opening of said oxidation catalyst device.

* * * * *